US008517495B2

(12) United States Patent
Iritani et al.

(10) Patent No.: US 8,517,495 B2
(45) Date of Patent: Aug. 27, 2013

(54) INKJET RECORDING APPARATUS AND INKJET RECORDING SYSTEM

(75) Inventors: Hinako Iritani, Kawasaki (JP); Hiroshi Tajika, Yokohama (JP); Hideki Takayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 234 days.

(21) Appl. No.: 12/767,173

(22) Filed: Apr. 26, 2010

(65) Prior Publication Data

US 2010/0271411 A1 Oct. 28, 2010

(30) Foreign Application Priority Data

Apr. 28, 2009 (JP) ..... 2009-109391

(51) Int. Cl.
*B41J 2/205* (2006.01)
*B41J 2/21* (2006.01)
*B41J 2/01* (2006.01)

(52) U.S. Cl.
USPC ..... 347/15; 347/43; 347/105

(58) Field of Classification Search
USPC ..... 347/5–16, 43, 100, 105, 106
See application file for complete search history.

(56) References Cited

U.S. PATENT DOCUMENTS 6,670,409 B2 12/2003 Yatake
7,262,882 B2 * 8/2007 Hagai et al. ..... 358/1.9

FOREIGN PATENT DOCUMENTS

JP 2001-121806 A 5/2001
JP 2003-191601 A 7/2003
JP 2004-026486 A 1/2004
JP 2005-178289 A 7/2005
JP 2008-254358 A 10/2008

* cited by examiner

*Primary Examiner* — Geoffrey Mruk
(74) *Attorney, Agent, or Firm* — Canon U.S.A., Inc. IP Division

(57) ABSTRACT

An apparatus is configured to perform recording with at least three types of inks that are similar in color and different in pigment density. The apparatus is capable of operating in a first mode for performing recording on a first recording medium using at least one of a second ink having a pigment density that is lower than that of a first ink and a third ink having a pigment density that is lower than that of the second ink, and in a second mode for performing recording on a second recording medium, which has a lower glossiness than the first recording medium, using at least the first ink.

15 Claims, 21 Drawing Sheets

FIG. 7

| | | INK | | | | | | | | | | |
|---|---|---|---|---|---|---|---|---|---|---|---|---|
| | | 1 | 2 | 3 | 4 | 5 | 6 | 7 | 8 | 9 | 10 | 11 |
| PIGMENT FLUID DISPERSION | 1 | 40 | 18 | 8 | | | | | | | | |
| | 2 | | | | 40 | 18 | 8 | | | | | |
| | 3 | | | | | | | 40 | 18 | | | |
| | 4 | | | | | | | | | 40 | 18 | 8 |
| GLYCERIN | | 5.0 | 5.0 | 5.0 | 5.0 | 5.0 | 5.0 | 5.0 | 5.0 | 5.0 | 5.0 | 5.0 |
| DIETHYLENE GLYCOL | | 5.0 | 5.0 | 5.0 | 5.0 | 5.0 | 5.0 | 5.0 | 5.0 | 5.0 | 5.0 | 5.0 |
| POLYETHYLENE GLYCOL | | 5.0 | 5.0 | 5.0 | 5.0 | 5.0 | 5.0 | 5.0 | 5.0 | 5.0 | 5.0 | 5.0 |
| SURFYNOL 465 | | 1.0 | 1.0 | 1.0 | 1.0 | 1.0 | 1.0 | 1.0 | 1.0 | 1.0 | 1.0 | 1.0 |
| ION-EXCHANGED WATER | | 44 | 66 | 76 | 44 | 66 | 76 | 44 | 66 | 44 | 66 | 76 |

DEDICATED TO COATED PAPER

DEDICATED TO PLAIN PAPER

SETTING FOR COATED PAPER

SETTING FOR PLAIN PAPER

TYPE OF RECORDING MEDIUM

| | |
|---|---|
| GLOSSY PAPER (PHOTO PAPER) | A |
| SEMI-GLOSSY PAPER | A |
| MAT PAPER (ART PAPER) | B |
| PLAIN PAPER | B |
| FILM | A |
| POSTCARD | B |
| TRANSPARENT SHEET FOR PROJECTOR (OHP) | A |
| CD | B |
| PHOTOGRAPHIC PRINTING PAPER | A |

DEDICATED TO MAT PAPER

DEDICATED TO GLOSSY PAPER

SETTING FOR GLOSSY PAPER

SETTING FOR MAT PAPER

FIG. 21

| PAPER TYPE | MODE | CONDITION | PRINT MODE | | |
|---|---|---|---|---|---|
| | | | FINE | NORMAL | FAST |
| GLOSSY PAPER | GLOSSINESS PRIORITIZED | INK SET | MEDIUM LIGHT | MEDIUM LIGHT | MEDIUM |
| | | NUMBER OF PASSES | 12 PASSES | 8 PASSES | 6 PASSES |
| | COLOR DEVELOPMENT PRIORITIZED | INK SET | DARK MEDIUM LIGHT | DARK MEDIUM LIGHT | DARK LIGHT |
| | | NUMBER OF PASSES | 16 | 12 | 8 |
| MAT PAPER | — | INK SET | DARK MEDIUM LIGHT | DARK MEDIUM LIGHT | DARK LIGHT |
| | | NUMBER OF PASSES | 16 | 12 | 8 |
| PLAIN PAPER | — | INK SET | — | DARK LIGHT | DARK |
| | | NUMBER OF PASSES | — | 4 | 1 |

INKJET RECORDING APPARATUS AND INKJET RECORDING SYSTEM

BACKGROUND OF THE INVENTION

1. Field of the Invention

The present invention relates to an inkjet recording apparatus and an inkjet recording system that can form high-quality images on various types of recording media.

2. Description of the Related Art

There are conventional inkjet recording apparatuses that can improve image quality in inkjet recording operations by using a plurality of inks having different color material densities. For example, there is an inkjet recording apparatus that uses light inks having lower color material densities, such as light yellow (light Y, LY), light magenta (light M, LM), and light cyan (light C, LC), in addition to four fundamental colors of Y, M, C, and K. It is generally known that graininess of recorded images can be reduced by positively using these light inks when highlight portions are printed.

Further, there is a conventional method capable of forming a high-quality image that is excellent in color developing properties as well as in gradation characteristics by determining an optimum combination of inks that are selectable from a plurality of predetermined inks having different color material densities according to the type of a recording medium to be used. The inkjet recording apparatuses that perform recording with a plurality of inks different in color material density perform important roles in improving the quality of recorded images.

On the other hand, recording of images using pigment inks that have excellent image fastness properties for a printed product compared to dye inks is desired. There are various types of recording media, such as plain papers represented by PPC sheets, coated papers including an ink receptive layer provided on a substrate (e.g., a wood-free sheet or a film), CD/DVD or comparable disks, OHP sheets, and postcards. Further, the coated papers that are currently available in the market to provide high image quality and high product quality can provide a wide variety of product types in the feel of material, from glossy papers having a mirror surface excellent in glossiness to mat papers having a mat surface.

The issue to be solved to attain high-quality images in the inkjet recording apparatuses using pigment inks differs depending on the type of a recording medium to be used. For example, a method discussed in U.S. Pat. No. 6,670,409 can improve not only color developing properties of the plain papers but also scuff resistances of the coated papers. In general, the plain papers are inferior to the coated papers in color developing properties. The coated papers are inferior to the plain papers in scuff resistance. According to the method discussed in U.S. Pat. No. 6,670,409, dark inks are mainly used for the plain papers and light inks containing polymers are mainly used for the coated papers.

However, according to the method discussed in U.S. Pat. No. 6,670,409, requirements of both high color developing properties for the mat papers and high glossiness for the glossy papers may not be satisfied simultaneously. More specifically, it is useful to use dark inks for the mat papers having excellent ink absorbency to obtain adequate color developing properties. However, if dark inks are used for the glossy papers having poor ink absorbency, residual color materials tend to form an undulated surface on a recording medium.

FIG. 1A illustrates two ink dots, each of which has been discharged from a recording head and impacted on a recording medium. As understood from the illustration in FIG. 1A, the height of a single ink dot becomes higher as the color material density of the used pigment ink is higher. The height difference between the respective ink dots decreases glossiness of a recorded image. To solve this issue, it may be useful to additionally coat the undulated surface of the recording medium with, for example, a transparent ink layer to reduce the roughness and realize sufficient glossiness. However, the consumption amount of the transparent ink may increase significantly.

SUMMARY OF THE INVENTION

According to an aspect of the present invention, an apparatus is configured to perform recording with at least three types of inks that are similar in color and different in pigment density. The apparatus is capable of operating in a first mode for performing recording on a first recording medium using at least one of a second ink having a pigment density that is lower than that of a first ink and a third ink having a pigment density that is lower than that of the second ink, and in a second mode for performing recording on a second recording medium, which has a lower glossiness than the first recording medium, using at least the first ink.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 7 illustrates example components that constitute inks according to the first exemplary embodiment.

FIG. 21 illustrates an example classification of setting contents with respect to an ink set and a recording operation according to a third exemplary embodiment.

DESCRIPTION OF THE EMBODIMENTS

Various exemplary embodiments, features, and aspects of the invention will be described in detail below with reference to the drawings.

First, the surface glossiness is a criterion usable to classify various recording media in the following exemplary embodiments of the present invention. An index indicating the glossiness of a recording medium is, for example, degree of glossiness and image clarity.

Figure 2A:
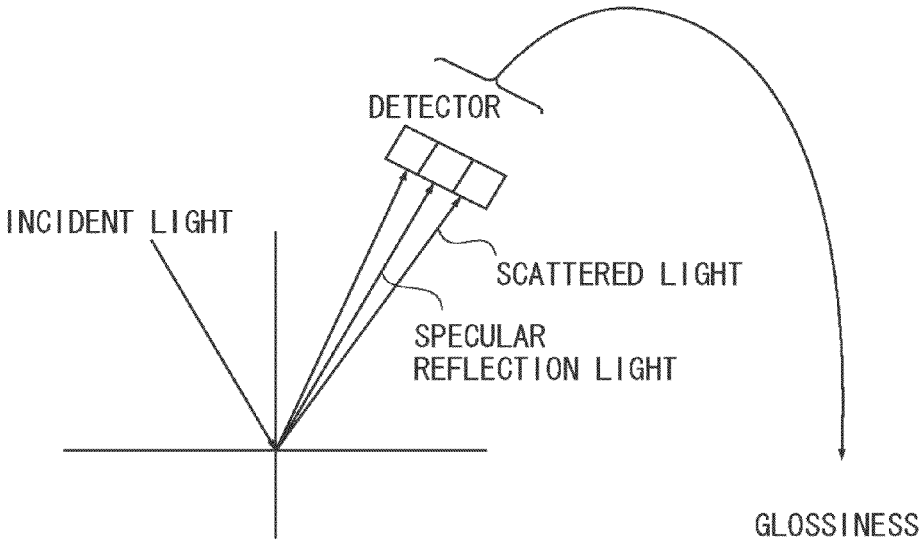
FIGS. 2A to 2C are views illustrating an example distribution with respect to the degree of glossiness.
Figure 2B:
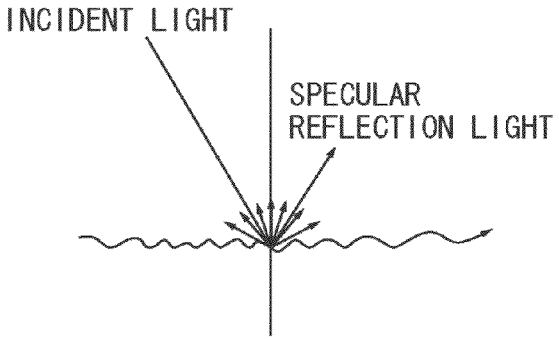
Figure 2C:
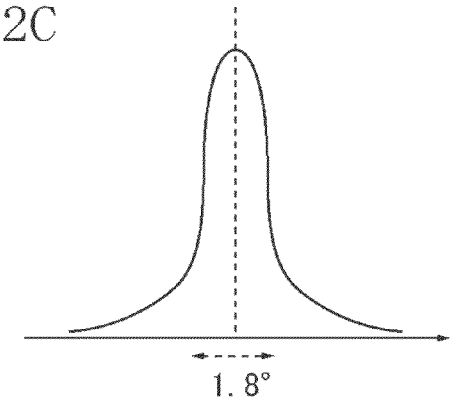

FIGS. 2A to 2C are views illustrating an example distribution of degree of glossiness. As illustrated in FIG. 2A, glossiness at a 20° mirror surface (hereinafter, referred to as "degree of glossiness") can be measured by detecting light reflected from a surface of a printed product using an appropriate detector (e.g., B-4632 (Japanese name; Micro-Haze Plus) manufactured by BYK-GARDNER).

The reflection light has a distribution within a predetermined angle relative to a central axis of its specular reflection light. As illustrated in FIG. 2C, the degree of glossiness can be detected within an opening width of, for example, 1.8° about the center of the detector. More specifically, in a case where reflection light is observable, the degree of glossiness can be defined as a reflectance of specular reflection light (i.e., light serving as the central axis of the distribution) relative to the incident light. In general, an observer can feel glossiness when the degree of glossiness is large. The degree of glossiness is a value to be defined in conformity with K5600 of Japanese Industry Standard (JIS).

FIG. 2B illustrates a comparative example, in which the quantity of specular reflection light decreases depending on the roughness of a printed image surface. As illustrated in FIG. 2B, when the surface is coarse, the amount of specular reflection light becomes smaller and a measured degree of glossiness becomes small.

On the other hand, the image clarity can be measured using, for example, JIS H8686 "image clarity measuring method for aluminum and aluminum alloy anode oxide film" or JIS J7105 "optical characteristics testing method for plastics." The image clarity represents a sharpness of an image reflected on a recording medium. For example, in a case where an illumination image gets blurred when reflected on a recording medium, the image clarity has a smaller value. In general, the glossy paper is a recording medium whose image clarity value is equal to or greater than 30. The mat paper is a recording medium whose image clarity value is less than 30.

Figure 3A:
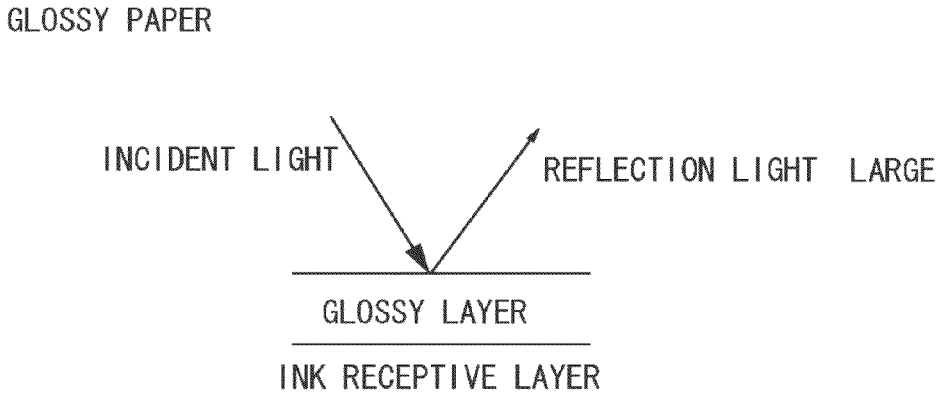
FIGS. 3A and 3B illustrate differences in the degree of glossiness between two recording media that are different in type.
Figure 3B:
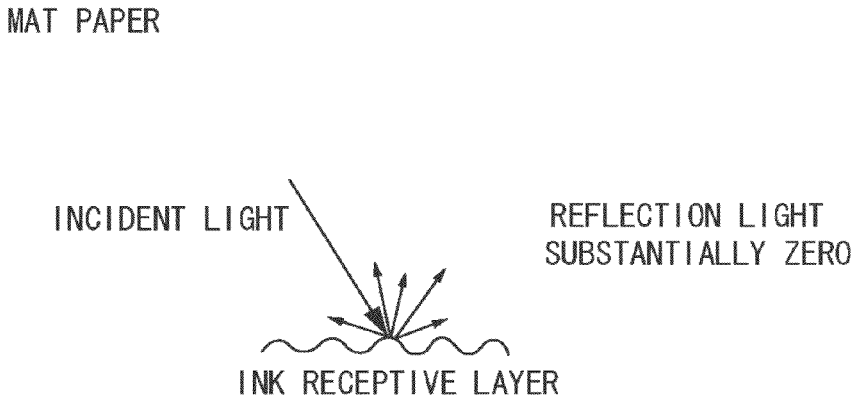

In the present exemplary embodiment, to simplify the following description, only the degree of glossiness is used as an index to be used in recording medium selection. FIGS. 3A and 3B illustrate differences in glossiness and surface roughness between two recording media that are different in type. More specifically, FIGS. 3A and 3B illustrate an example relationship between surface roughness and reflection light in a glossy paper and a mat paper, respectively. In the present exemplary embodiment, a recording medium having a degree of glossiness equal to or greater than 2% is classified into the glossy paper and a recording medium having a degree of glossiness less than 2% is classified into the mat paper.

Figure 4:
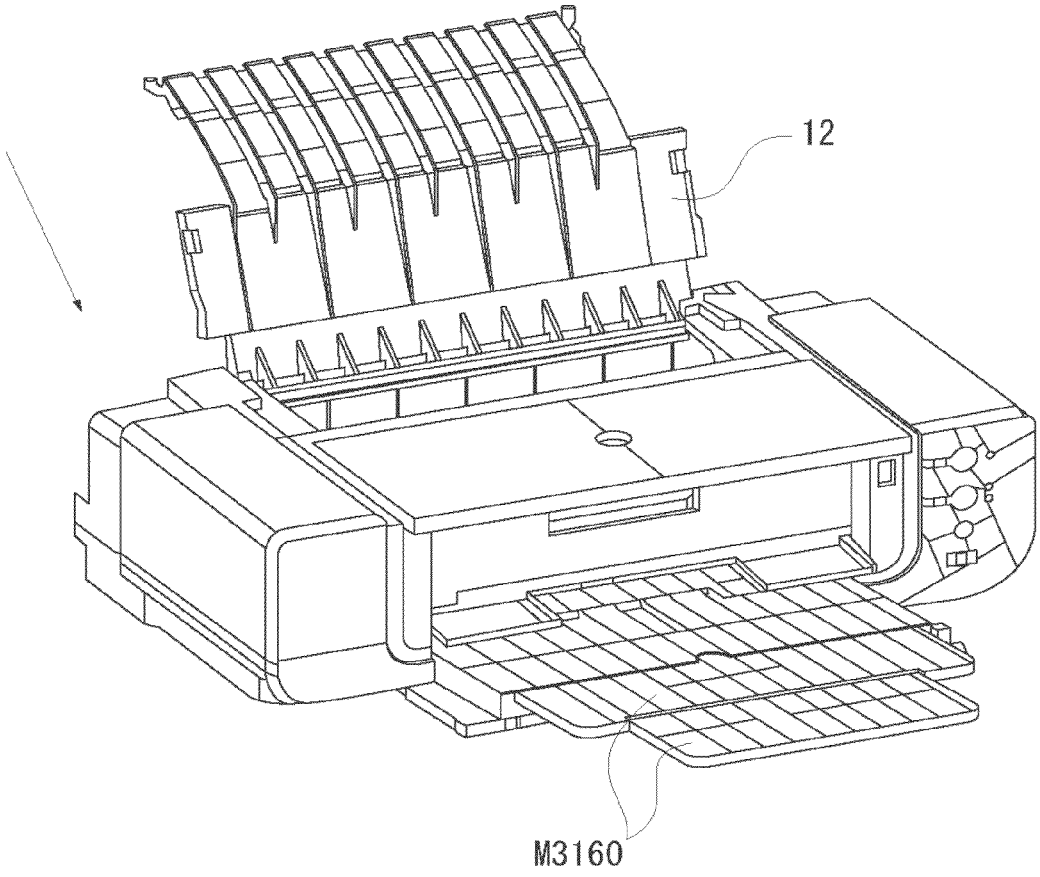
FIG. 4 is a perspective view illustrating an appearance of an inkjet recording apparatus according to the first exemplary embodiment of the present invention.
Figure 5:
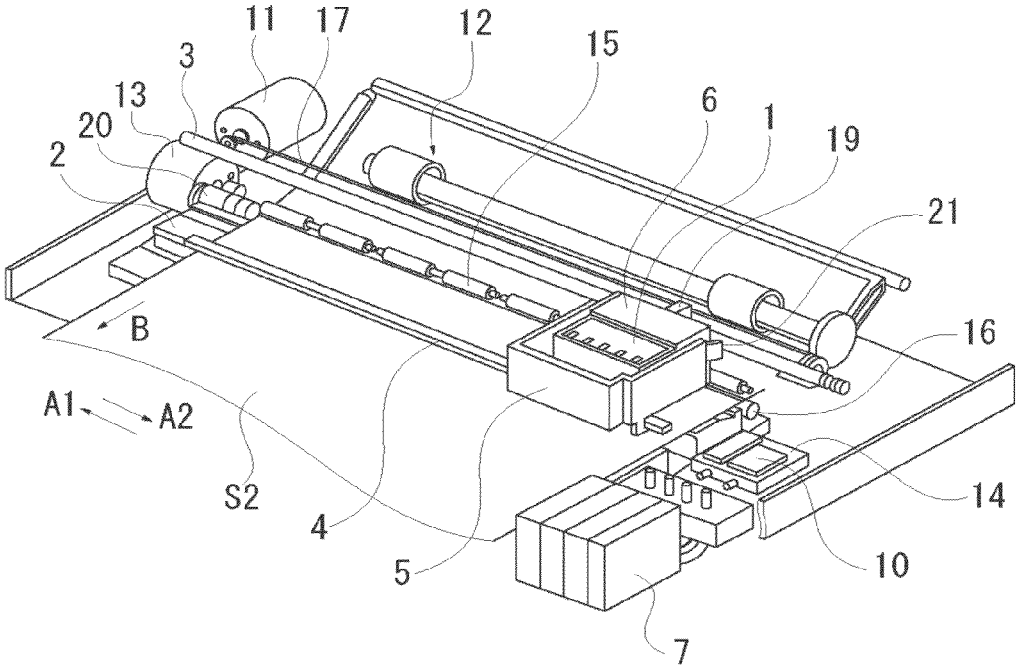
FIG. 5 is a perspective view illustrating an inner structure of the inkjet recording apparatus according to the first exemplary embodiment.

Next, an example apparatus configuration and an example ink component configuration, which are commonly used in the following exemplary embodiments, are described below. Further, an example of image processing is described below. FIG. 4 is a perspective view illustrating an appearance of an inkjet recording apparatus according to the present exemplary embodiment. FIG. 5 is a perspective view illustrating an inner structure of the inkjet recording apparatus.

In the present exemplary embodiment, a recording medium can be inserted from a sheet feeding tray 12 illustrated in FIG. 4 in a direction indicated by an arrow. The inserted recording medium can be intermittently conveyed for image formation and can be discharged to a sheet discharge tray M3160.

In FIG. 5, a recording head 1 mounted on a carriage 5 can discharge ink droplets from nozzles thereof to form an image on a recording medium S2 while moving in forward and backward directions indicated by arrows A1 and A2 along a guide rail 4. For example, the recording head 1 includes a plurality of nozzle groups that can discharge different inks. For example, the recording head 1 can use eleven inks of different colors, such as dark cyan (C), medium cyan (MC), light cyan (LC), dark magenta (M), medium magenta (MM), light magenta (LM), dark yellow (Y), medium yellow (MY), dark black (K), medium black (MK), and light black (LK). The above-described different color inks are stored in an ink tank 7. Each ink can be supplied from the ink tank 7 to the recording head 1 via a supply tube.

Further, a carriage motor 11 can generate a driving force to be transmitted via a timing belt 17 to the carriage 5. A guide shaft 3 and the guide rail 4 cooperatively guide the carriage 5 to move in the forward and backward directions indicated by the arrows A1 and A2 (i.e., in the main scanning direction).

An encoder sensor 21 is provided on the carriage 5 to read a linear scale 19 extending along a moving direction of the carriage 5. The encoder sensor 21 generates a signal that represents a carriage position when the carriage 5 moves in the above-described main scanning direction. The recording head 1 forms an image on a recording medium in response to the above-described reciprocating movement of the carriage 5. In the present exemplary embodiment, the recording medium S2 having been fed from the sheet feeding tray 12 is sandwiched between a conveyance roller 16 and a pinch roller 15 and is conveyed to a platen 2.

When the carriage 5 completes recording by an amount corresponding to one scanning operation in the direction A1, a conveyance motor 13 drives the conveyance roller 16 via a linear wheel 20. The recording medium S2 is thus conveyed by a predetermined amount in a direction indicated by an arrow B (i.e., in the sub scanning direction). Subsequently, the recording head 1 forms an image on the recording medium S2 while the carriage 5 performs the scanning operation in the direction A2. As illustrated in FIG. 5, a head cap 10 and a recovery unit 14 are provided in the vicinity of a home position of the carriage 5. Both the head cap 10 and the recovery unit 14 can be used to intermittently perform recovery processing for the recording head 1, if necessary.

The inkjet recording apparatus repetitively performs the above-described operations to complete recording of an image corresponding to one page on a recording medium and discharges the recording medium to the sheet discharge tray M3160, thereby accomplishing recording of one sheet.

Figure 6:
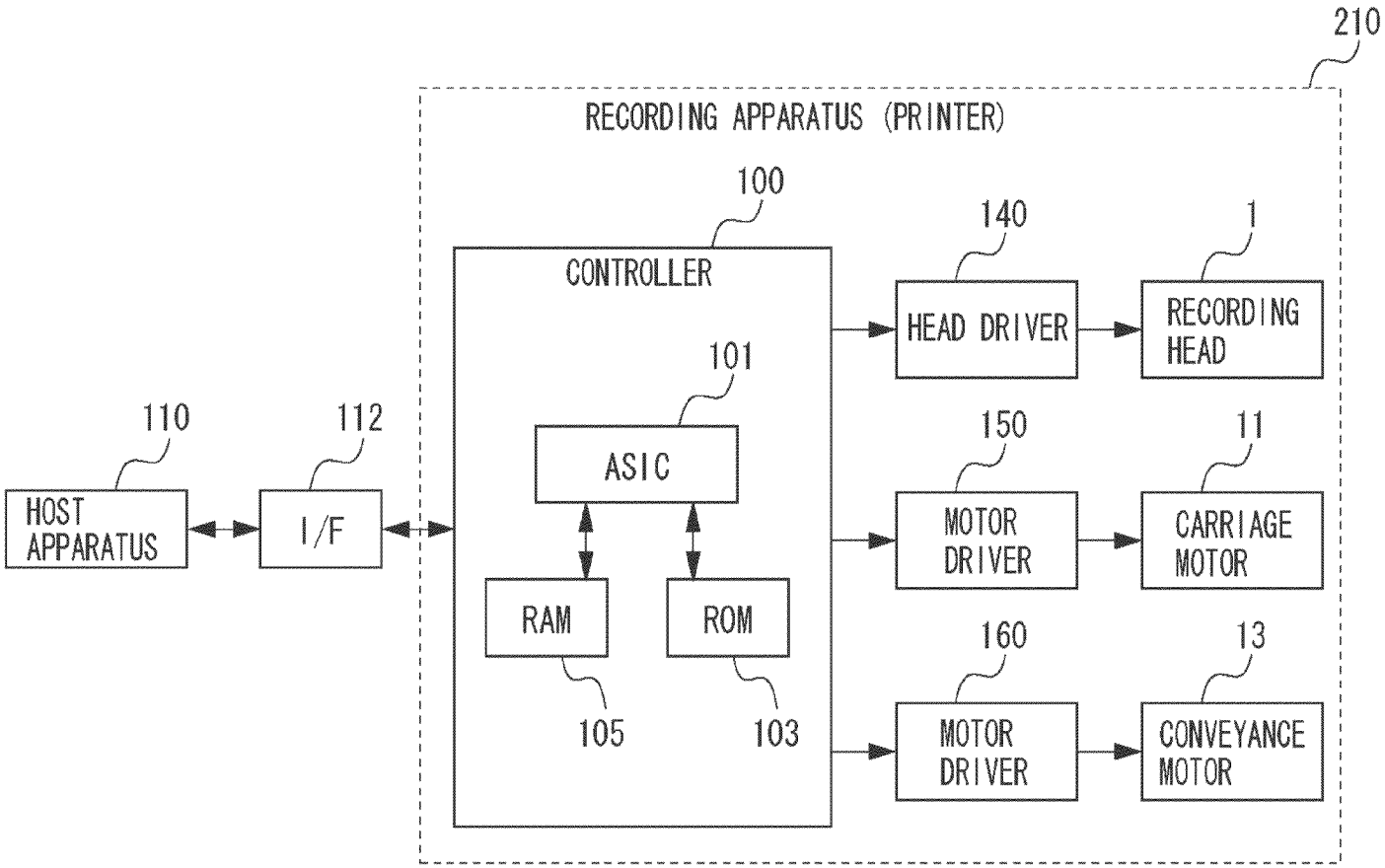
FIG. 6 is a block diagram illustrating an electric control system provided in the inkjet recording apparatus according to the first exemplary embodiment.

FIG. 6 is a block diagram illustrating a control configuration of the inkjet recording apparatus according to the present exemplary embodiment. A controller 100 is a main control unit that is, for example, constituted by a microcomputer. The controller 100 includes an ASIC 101, a read only memory (ROM) 103, and a random access memory (RAM) 105. The ROM 103 stores various dot layout patterns, mask patterns, and other fixed data. The RAM 105 can provide an image data rasterizing area and a work area. The ASIC 101 can execute sequential processing including reading a program from the ROM 103 and recording image data on a recording medium. More specifically, the ASIC 101 selects a mask pattern based on information corresponding to an ink discharge amount to divide image data, and then generates recording data of each pass.

A host apparatus 110 is an image data supply source, which is described below in detail. For example, the host apparatus 110 is a computer that can generate and process print related image data. Alternatively, the host apparatus 110 can be a reader unit configured to read images. The host apparatus 110 can transmit and receive image data, other commands, and status signals, via an interface (I/F) 112, to and from the controller 100.

A head driver 140 is a driver that can drive the recording head 1 based on print data. A motor driver 150 is a driver that can drive the carriage motor 11. A motor driver 160 is a driver that can drive the conveyance motor 13.

Various components of pigment inks that can be used for the inkjet recording apparatus according to the present exemplary embodiment are described below.

An aqueous medium that contains water and water-soluble organic solvent used for the inks can also be used in the present exemplary embodiment. In one embodiment, the content (mass %) of the water-soluble organic solvent included in the ink is equal to or greater than 3.0 mass % and equal to or less than 50.0 mass % relative to the entire mass of the ink. Also the content (mass %) of the water in the ink is equal to or greater than 50.0 mass % and equal to or less than 95.0 mass % relative to the entire mass of the ink.

More specifically, the water-soluble organic solvent can be selected, for example, from the following organic solvent group. The organic solvent group according to the present exemplary embodiment, for example, includes alkyl alcohols having a carbon number of 1 to 6 (methanol, ethanol, propanol, propanediol, butanol, butanediol, pentanol, pentanediol, hexanol, hexanediol, etc.), amides (dimethylformamide, dimethylacetamide, etc.), ketones or ketoalcohols (acetone, diacetonealcohol, etc.), ethers (tetrahydrofuran, dioxane, etc.), polyalkylene glycols (polyethylene glycol, polypropylene glycol, etc, which have the average molecular weight of 200, 300, 400, 600, or 1,000), alkylene glycols including an alkylene group having a carbon number of 2 to 6 (ethylene glycol, propylene glycol, butylene glycol, triethylene glycol, 1,2,6-hexanetriol, thiodiglycol, hexylene glycol, diethylene glycol, etc.), lower alkyl ether acetate (polyethylene glycol monomethylether acetate, etc.), glycerin, lower alkyl ethers of multi-valued alcohols (ethylene glycol monomethyl (or ethyl)ether, diethylene glycol methyl (or ethyl)ether, triethylene glycol monomethyl (or ethyl)ether, etc.), and others (N-methyl-2-pyrolidone, 2-pyrolidone, 1,3-dimethyl-2-imidazolidinone, etc.). The water used may be deionized water (ion-exchanged water).

In one embodiment, carbon black or organic pigment is used as the pigment. The content (mass %) of the pigment included in the ink is equal to or greater than 0.1 mass % and equal to or less than 15.0 mass % relative to the entire mass of the ink and the carbon black (furnace black, lamp black, acetylene black, channel black, etc.) is used as the pigment of the black ink. More specifically, the following goods on the market can be used. For example, the black ink can be selected from Ravan: 7000, 5750, 5250, 5000ULTRA, 3500, 2000, 1500, 1250, 1200, 1190ULTRA-II, 1170, 1255 (which are manufactured by COLOMBIA), black pearls L, Regal: 330R, 400R, 660R, Mogul L, Monarch: 700, 800, 880, 900, 1000, 1100, 1300, 1400, 2000, Vulcan XC-72R (which are manufactured by CABOT), color black: FW1, FW2, FW2V, FW18, FW200, S150, S160, S170, Printex: 35, U, V, 140U, 140V, special black: 6, 5, 4A, 4 (which are manufactured by Degussa), No. 25, No. 33, No. 40, No. 47, No. 52, No. 900, No. 2300, MCF-88, MA600, MA7, MA8, MA100 (which are manufactured by MITSUBISHI CHEMICAL), or any other carbon black that can be newly prepared for the present invention. It is needless to say that the present invention is not limited to the above-described example products. Any type of conventional carbon black can be also used. Further, the black ink is not limited to the above-described carbon black. For example, fine particles of a magnetic material (magnetite, ferrite, etc.) and titanic black can be also used as the pigment.

More specifically, the organic pigment can be selected, for example, from the following organic pigment group. The organic pigment group according to the present exemplary embodiment, for example, includes water-insoluble azo pigment (toluidine red, toluidine maroon, Hansa yellow, benzidine yellow, pyrazolone red, etc), water-soluble azo pigment (ritor red, helio bordeaux, pigment scarlet, permanent red 2B, etc.), vat dye derivative (alizarin, indanthrone, thioindigo maroon), phthalocyanine-based pigment (phthalocyanine blue, phthalocyanine green, etc.), quinacridon-based pigment (quinacridon red, quinacridon magenta, etc.), perylene-based pigment (perylene red, perylene scarlet, etc.), isoindolinone-based pigment (isoindolinone yellow, isoindolinone orange, etc.), imidazolone-based pigment (benzimidazole yellow, benzimidazole orange, benzimidazole red, etc.), pyranthrone-based pigment (pyranthrone red, pyranthrone orange, etc.), indigo-based pigment, condensation azo-based pigment, thioindigo-based pigment, diketopyrrolopyrrole-based pigment, and other pigments (flavanthrone yellow, acylamide yellow, quinophthalone yellow, nickel azo yellow, copper azo methine yellow, perinone orange, anthron orange, dianthraquinonyl red, and dioxazine violet, etc.). It is needless to say that that the present invention is not limited to the above-described example materials.

Further, the organic pigment can be selected, for example, from the following organic pigment group in a case where the organic pigment is expressed using a color index (C.I.) number. The organic pigment group according to the present exemplary embodiment, for example, includes C.I. pigment yellow (: 12, 13, 14, 17, 20, 24, 74, 83, 86, 93, 97, 109, 110, 117, 120, 125, 128, 137, 138, 147, 148, 150, 151, 153, 154, 166, 168, 180, 185, etc.), C.I. pigment orange (: 16, 36, 43, 51, 55, 59, 61, 71, etc.), C.I. pigment red (: 9, 48, 49, 52, 53, 57, 97, 122, 123, 149, 168, 175, 176, 177, 180, 192, and further, 215, 216, 217, 220, 223, 224, 226, 227, 228, 238, 240, 254, 255, 272, etc.), C.I. pigment violet (: 19, 23, 29, 30, 37, 40, 50, etc.), C.I. pigment blue (: 15, 15:1, 15:3, 15:4, 15:6, 22, 60, 64, etc.), C.I. pigment green (: 7, 36, etc.), and C.I. pigment brown (: 23, 25, 26, etc.). It is needless to say that the present invention is not limited to the above-described example materials.

A dispersing agent to be used to diffuse the above-described pigment into an aqueous medium can be any water-soluble resin. In particular, in one embodiment, an average molecular weight of the dispersing agent is equal to or greater than 1,000 and equal to or less than 30,000. More specifically, the average molecular weight of the dispersing agent is equal to or greater than 3,000 and equal to or less than 15,000. Also, the content (mass %) of the dispersing agent is equal to or greater than 0.1 mass % and equal to or less than 5.0 mass % relative to the entire mass of the ink.

More specifically, the dispersing agent can be selected, for example, from the following dispersing agent group. The dispersing agent group according to the present exemplary embodiment, for example, includes styrene, vinylnaphthalene, α,β-ethylene unsaturated carboxylic acid aliphatic alcohol ester, acrylic acid, maleic acid, itaconic acid, fumaric acid, vinyl acetate, vinyl pyrrolidone, acrylamide, or a polymer including a derivative monomer of the above. In this embodiment, one or more monomers constituting the polymer is a hydrophilic monomer. For example, block copolymer, random copolymer, graft copolymer, or their salts can be used. Alternatively, natural resins (rosin, shellac, starch, etc.) can be used. The above-described resins are an alkalic fusible type that are soluble in a dissolved base containing aqueous solution.

To adjust the surface tension of the ink that constitutes an ink set, an appropriate surface active agent (anionic surface active agent, nonionic surface active agent, amphoteric surface active agent, etc.) is used. More specifically, polyoxyethylene alkyl ether, polyoxyethylene alkylphenols, acetylene glycol compound, acetylene glycol ethylene oxide addition product, etc. can be used.

The ink that constitutes an ink set may contain a moisture retention solid content (urea, urea derivative, trimethylolpropane, trimethylolethane, etc.) to maintain moisture retention properties, in addition to the above-described components. In one embodiment, the content (mass %) of the moisture retention solid component contained in the ink is equal to or greater than 0.1 mass % and equal to or less than 20.0 mass % relative to the entire mass of the ink. The content (mass %) of the moisture retention solid component contained in the ink is equal to or greater than 3.0 mass % and equal to or less than 10.0 mass %.

Further, the ink that constitutes an ink set may contain various addition agents (pH adjustor, rust proof agent, antiseptic agent, mildewproofing agent, anti-oxidizing agent, anti-reduction agent, evaporation accelerating agent, etc., if necessary, in addition to the above-described component).

Next, the usable ink in the present exemplary embodiment is described below in more detail. The present invention is not limited to the following exemplary embodiments and can be realized in various ways without departing from the gist of the invention. Further, "parts" and "%" in the following description are the units based on the mass, unless it is mentioned otherwise.

The present exemplary embodiment employs the following procedures to prepare pigment fluid dispersions 1 to 4. In the following description, the dispersing agent is an aqueous solution that can be obtained by neutralizing a styrene-acrylic acid copolymer having an acid value of 200 and an average molecular weight of 10,000 with 10 mass % aqueous sodium hydroxide.

<Preparation of Pigment Fluid Dispersion 1 Including C.I. Pigment Red 122>

The procedure for preparing the pigment fluid dispersion 1 includes mixing 10 parts of pigment (C.I. pigment red 122), 20 parts of dispersing agent, and 70 parts of ion-exchanged water, and then diffusing the mixture in a batch-type vertical sand mill for three hours. The procedure for preparing the pigment fluid dispersion 1 further includes performing centrifugal separation processing to remove coarse particles, and then performing pressurized filtering using a cellulose acetate filter having a pore size 3.0 μm (manufactured by ADVANTEC), thereby obtaining the pigment fluid dispersion 1 that has a pigment density of 10 mass %.

<Preparation of Pigment Fluid Dispersion 2 Including C.I. Pigment Blue 15:3>

The procedure for preparing the pigment fluid dispersion 2 includes mixing 10 parts of pigment (C.I. pigment blue 15:3), 20 parts of dispersing agent, and 70 parts of ion-exchanged water, and then diffusing the mixture using the batch-type vertical sand mill for five hours. The procedure for preparing the pigment fluid dispersion 2 further includes performing centrifugal separation processing to remove coarse particles, and then performing pressurized filtering using the cellulose acetate filter having a pore size 3.0 μm (manufactured by ADVANTEC), thereby obtaining the pigment fluid dispersion 2 that has a pigment density of 10 mass %.

<Preparation of Pigment Fluid Dispersion 3 Including C.I. Pigment Yellow 74>

The procedure for preparing the pigment fluid dispersion 3 includes mixing 10 parts of pigment (C.I. pigment yellow 74), 20 parts of dispersing agent, and 70 parts of ion-exchanged water, and then diffusing the mixture in the batch-type vertical sand mill for one hour. The procedure for preparing the pigment fluid dispersion 3 further includes performing centrifugal separation processing to remove coarse particles, and then performing pressurized filtering using the cellulose acetate filter having a pore size 3.0 μm (manufactured by ADVANTEC), thereby obtaining the pigment fluid dispersion 3 that has a pigment density of 10 mass %.

<Preparation of Pigment Fluid Dispersion 4 Including C.I. Pigment Black 7>

The procedure for preparing the pigment fluid dispersion 4 includes mixing 10 parts of carbon black pigment (C.I. pigment black 7), 20 parts of dispersing agent, and 70 parts of ion-exchanged water, and then diffusing the mixture using the batch-type vertical sand mill for three hours. In this case, the circumferential velocity in the diffusion processing was doubled compared to that for the preparation of the pigment fluid dispersion 1. The procedure for preparing the pigment fluid dispersion 4 further includes performing centrifugal separation processing to remove coarse particles, and then performing pressurized filtering using the cellulose acetate filter having a pore size 3.0 μm (manufactured by ADVANTEC), thereby obtaining the pigment fluid dispersion 4 that has a pigment density of 10 mass %.

An example procedure for preparing inks 1 to 11 includes mixing a plurality of components illustrated in FIG. 7, sufficiently agitating the mixed components, and then performing pressurized filtering using a cellulose acetate filter having a pore size of 0.8 μm (manufactured by ADVANTEC). The pigment density of respective ink components can be set according to the following reasons. In this embodiment, the light ink has a pigment density of 0.8% to 1% in a case where an ink dot with a discharge amount of 3.5 pl is used in a recording operation to reduce graininess. It is The medium ink has a pigment density of 1.5% to 2.5% because the medium ink maintains both image glossiness and color developing properties for a glossy recording medium (e.g., a glossy paper).

More specifically, the above-described density setting is useful because the height of a single ink dot itself can be lowered by reducing the density of a color material to be used for a glossy recording medium, within a range in which color reproduction can be realized. Even in a case where ink dots are overlapped on a recording medium surface, the above-described density setting is useful to prevent the recording medium surface from being greatly undulated. On the other hand, the dark ink is mainly used for non-glossy recording media (mat paper, plain paper, etc.). These papers are inferior to the glossy recording medium in color developing properties. Accordingly, a pigment density of the dark ink is equal to or greater than 2.5% so that high color developing image can be formed on such a recording medium.

The above-described components are examples for the inks to be used in the present exemplary embodiment. Next, example image processing to be performed by the inkjet recording apparatus according to the present exemplary embodiment is described below.

Figure 8:
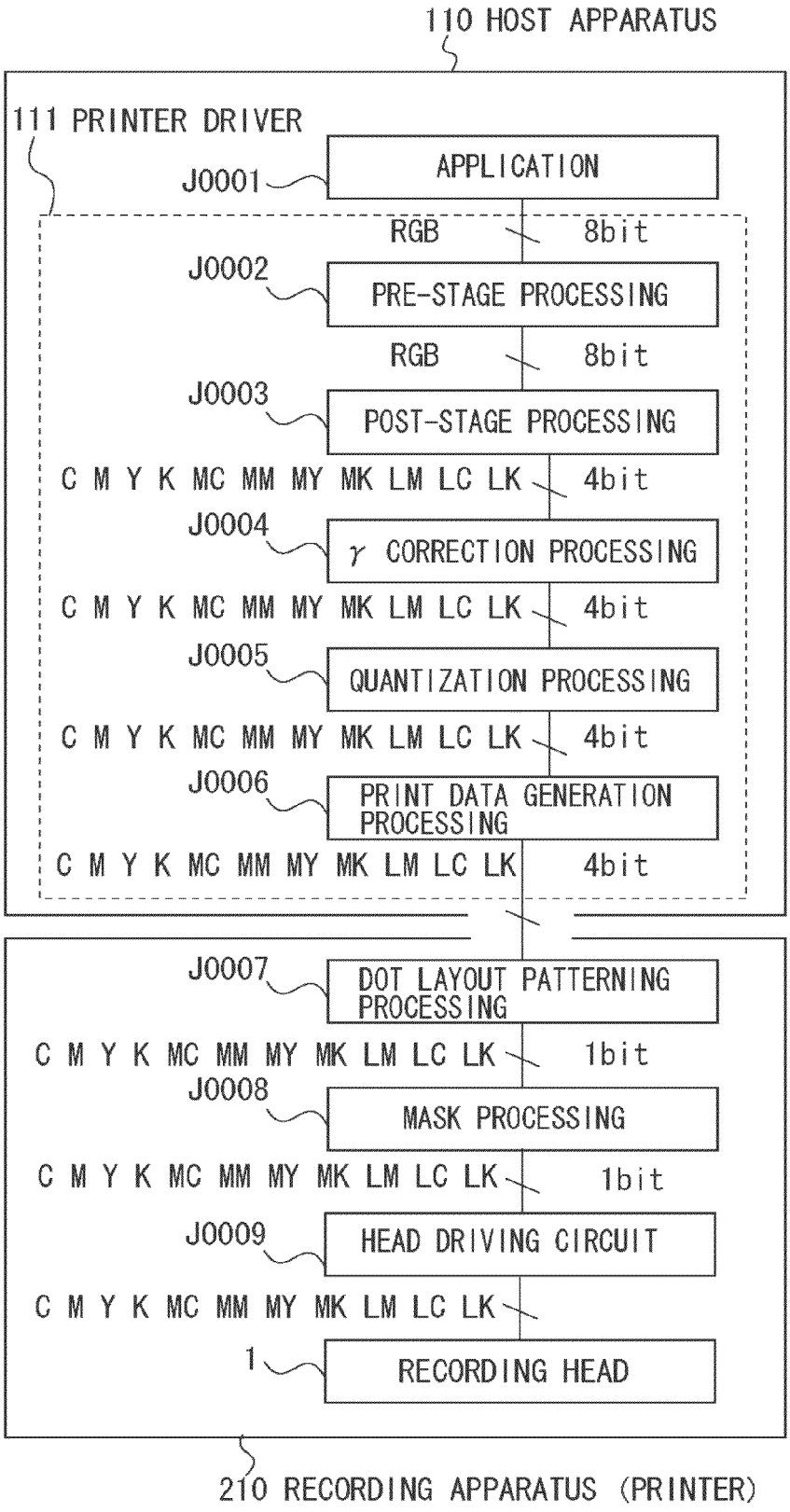
FIG. 8 illustrates example image processing to be performed by the inkjet recording apparatus according to the first exemplary embodiment.

FIG. 8 is a block diagram illustrating an example flow of image data conversion processing to be performed by an inkjet recording system according to the present exemplary embodiment. The flow illustrated in FIG. 8 is image processing for converting 8-bit (256 gradations) image data of respective input RGB colors into 1-bit data of each ink color and outputting the converted data.

The recording system includes the host apparatus 110 and a recording apparatus (printer) 210. The host apparatus 110 is, for example, constituted by a personal computer (PC). The host apparatus 110 includes an application J0001 and a printer driver 111. The printer driver 111 is a driver dedicated to the recording apparatus according to the present exemplary embodiment.

The application J0001 can execute processing for generating image data to be transmitted to the printer driver 111 and processing for setting recording control information (i.e., information to be used to control recording processing) based on information designated by a user who can operate the host apparatus 110 while viewing a UI screen displayed on a monitor of the host apparatus 110.

Figure 9:
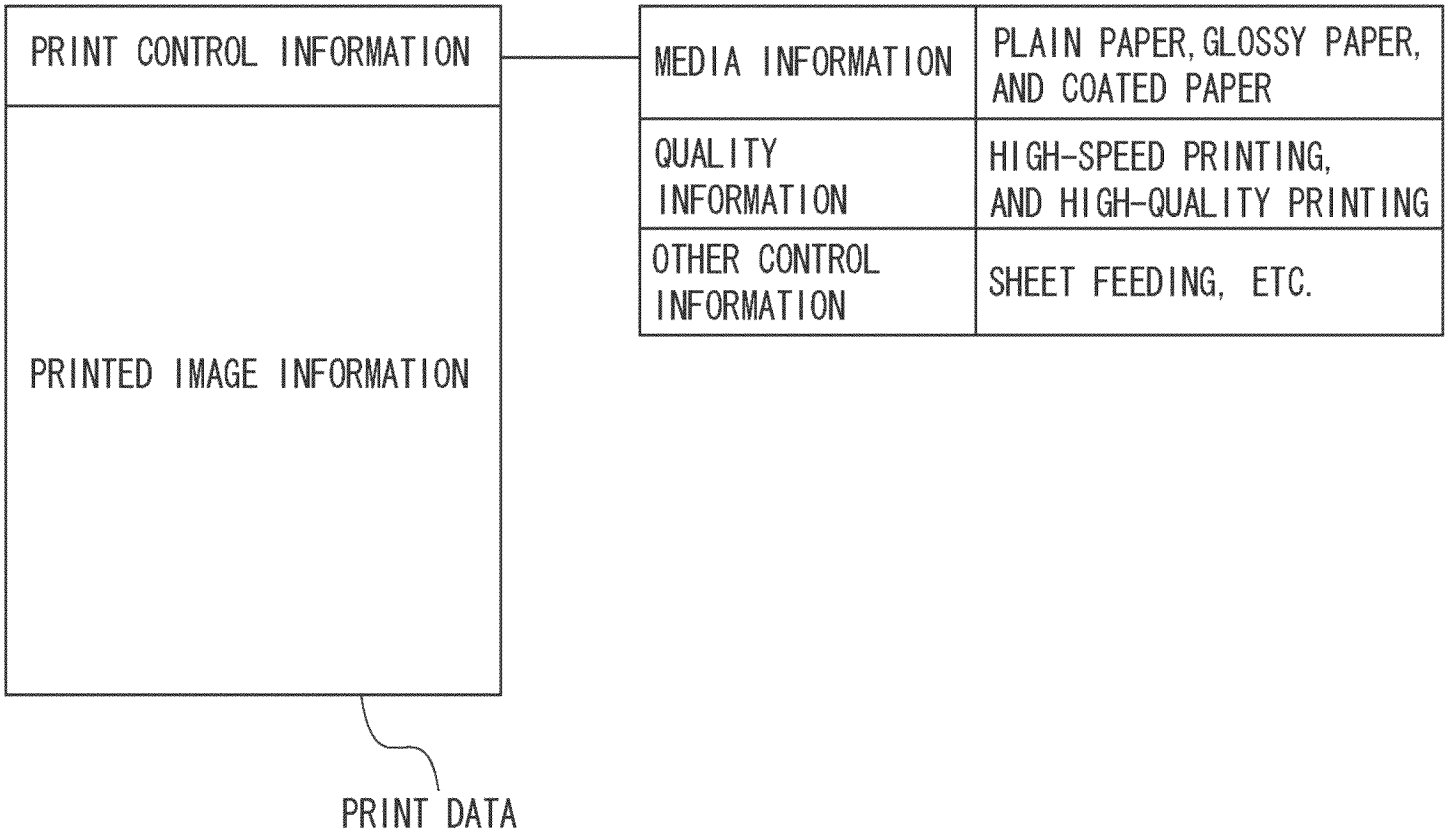
FIG. 9 illustrates an example of recording data to be sent from a printer driver to the inkjet recording apparatus according to the first exemplary embodiment.

FIG. 9 illustrates an example configuration of the image data information and the recording control information. The recording control information includes "recording media information", "recording quality information", and "other control information" (e.g., sheet feeding method). The recording media information describes a type of a recording medium (i.e., an object to be subjected to the recording processing), i.e., any one type of recording medium selected from plain paper, glossy paper, postcard, printable disk, etc. The recording quality information describes a recording quality, in which any one type of quality selected from "fine", "normal", and "fast" is defined. The image data and the recording control information having been processed by the application are sent to the printer driver 111 when the recording apparatus (printer) 210 performs recording processing.

The printer driver 111 includes, as processing to be executed, pre-stage processing J0002, post-stage processing J0003, γ correction processing J0004, quantization processing J0005, and print data generation processing J0006. Each processing is simply described below.

In the pre-stage processing J0002, the printer driver 111 performs color gamut mapping. The color gamut mapping is processing for converting a color gamut to be reproduced by R, G, and B image data defined according to the standard RGB (sRGB) into data that can be mapped in a color gamut to be reproduced by the printer. More specifically, the printer driver 111 converts data of 256 gradations that can express 8-bit R, G, and B data into 8-bit R, G, and B data that are different in color gamut, using a three-dimensional lookup table (LUT).

In the post-stage processing J0003, the printer driver 111 converts the R, G, and B data having been subjected to the above-described color gamut mapping into 8-bit color separation data, which is a combination of inks capable of reproducing a color represented by the data, respectively, based on a three-dimensional LUT table that can be used for post-stage processing. In the present exemplary embodiment, the printer driver 111 converts the R, G, and B data into color separation data representing the above-described eleven colors of C, MC, LC, M, MM, LM, Y, MY, K, MK, and LK. In the present exemplary embodiment, similar to the pre-stage processing, the printer driver 111 performs the conversion based on interpolation calculation in addition to the calculation based on the three-dimensional LUT.

In the γ correction processing J0004, the printer driver 111 performs processing for converting the color separation data of respective colors having been obtained by the post-stage processing J0003 into density values (gradation values) for respective colors. More specifically, the printer driver 111 performs processing for converting the above-described color separation data into data linearly corresponding to gradation characteristics of the printer using a one-dimensional LUT.

In the quantization processing J0005, the printer driver 111 performs quantization processing for converting 8-bit color separation data of respective colors having been subjected to the γ correction into 4-bit data. In the present exemplary embodiment, the printer driver 111 performs conversion from 8-bit data of 256 gradations to 4-bit data of 16 gradations using an error diffusion method. The 4-bit recorded image data can be used as index data indicating a dot layout pattern in dot layout patterning processing to be performed by the recording apparatus. The quantized data of 16 gradations for respective colors serve as gradation value information that indicates any one of gradation levels 0 to 16.

In the print data generation processing J0006, the printer driver 111 performs processing for generating print data that is constituted by the above-described recording control information and 4-bit recorded image data having been generated through the quantization processing J0005. The print data generated in the manner described above is then supplied to the recording apparatus 210.

When the recording apparatus (printer) 210 receives the print data from the host apparatus 110, the printer performs dot layout patterning processing J0007 and mask processing J0008 on the input print data.

In the dot layout patterning processing J0007, the printer performs binarization processing for converting input 16-value gradation information into a dot layout pattern. The dot layout patterning processing J0007 can generate binary data that indicates whether to discharge ink from the printer.

In the mask processing J0008, the printer performs uses a plurality of mask patterns that are in a mutually complementary relationship, and converts the dot layout of each color having been determined through the above-described dot layout patterning processing J0007 into data including recording scanning timing information.

The above-described recording data can be supplied to a head driving circuit J0009 at appropriate timing in synchronization with a plurality of recording passes during a multi-pass recording operation. Then, the drive circuit J0009 converts the input recording data into a drive pulse for the recording head 1. The recording head 1 discharges ink (or an ink droplet) of each color based on the drive pulse at predetermined timing. Thus, the printer can perform an ink discharge operation according to the recording data to accomplish recording of an image on a recording medium.

Figure 10:
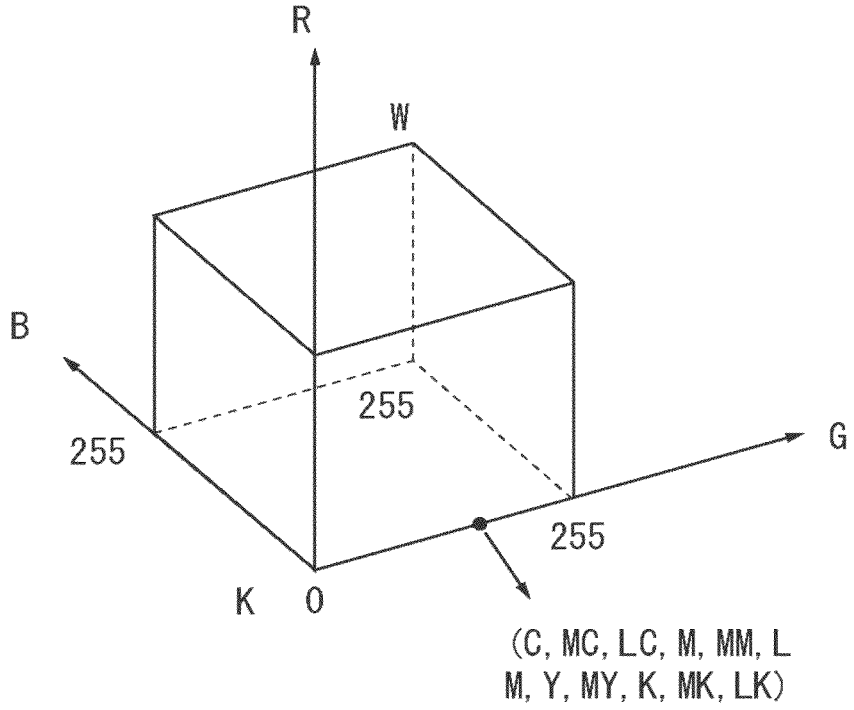
FIG. 10 illustrates an example of a three-dimensional lookup table (LUT) that can be used in post-stage processing.

Next, the above-described three-dimensional LUT to be used in the post-stage processing J0003 is described below in more detail. FIG. 10 illustrates an example of the three-dimensional LUT to be used in the post-stage processing. As illustrated in FIG. 10, values of C, MC, LC, M, MM, LM, Y, MY, K, MK, and LK are allocated to corresponding grid points representing R, G, and B values of 256 gradations that can be reproduced by the printer. For example, a grid point (R, G, B)=(0, 0, 0) represents black (K) that is lowest in luminosity, and a grid point (R, G, B)=(255, 255, 255) represents white (W) that in highest in luminosity.

Figure 11:
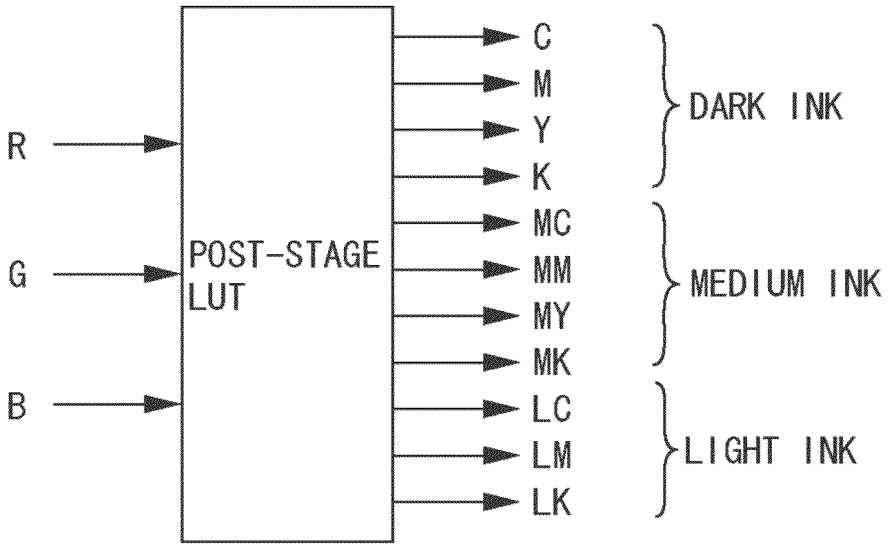
FIG. 11 illustrates an example of the post-stage processing.

FIG. 11 illustrates example processing for converting the R, G, and B data into values representing eleven ink colors referring to the above-described LUT. The printer driver 111 stores a plurality types of three-dimensional LUTs that can be used for the post-stage processing so that an optimum three-dimensional LUT can be selected considering the inks to be used in the recording processing and color developing properties of a recording medium to be used. In the present exemplary embodiment, the printer driver 111 selects and uses an optimum one of the plurality types of three-dimensional LUTs based on a signal indicating the type of a recording medium.

Figure 12:
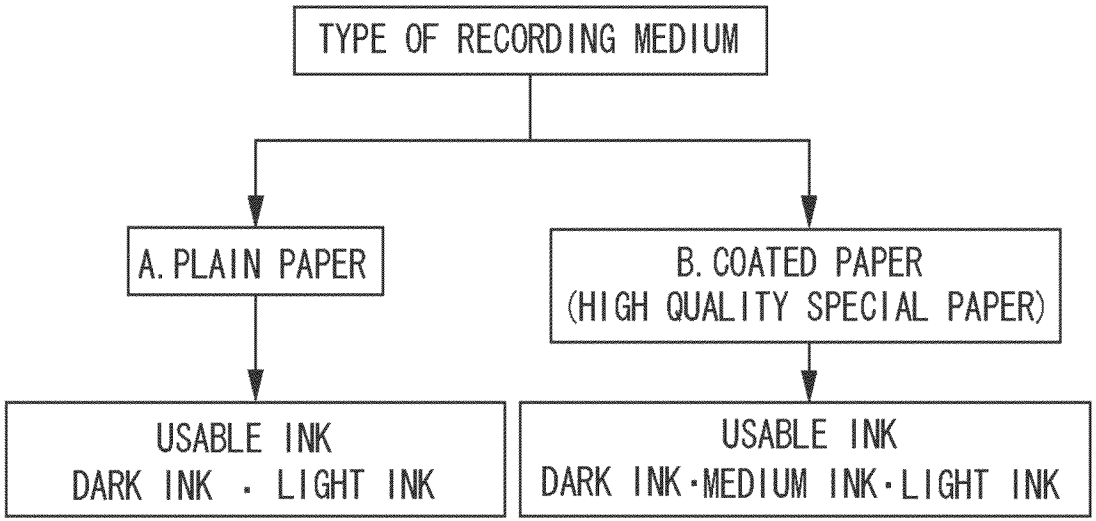
FIG. 12 illustrates a relationship between each conventional recording medium and usable inks.

FIG. 12 illustrates a comparative example. According to the example illustrated in FIG. 12, a combination of a dark ink (i.e., a first ink) that is highest in pigment density, a medium ink (i.e., a second ink) that is lower than the dark ink in pigment density, and a light ink (i.e., a third ink) that is lower than the medium ink in pigment density is usable as three types of similar color inks for the coated paper. Further, a combination of the dark ink (i.e., the first ink) and the light ink (i.e., the third ink) is usable as two types of similar color inks for the plain paper. An example recording method using the above-described inks is described below.

Figure 13B:
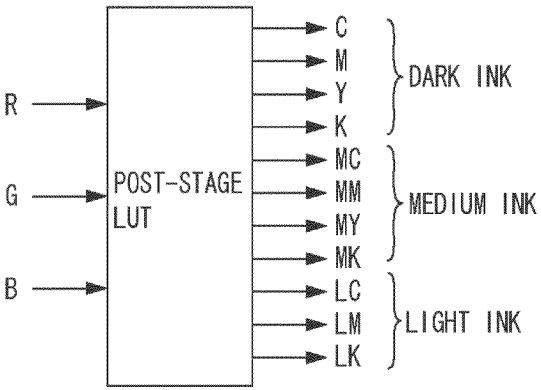
FIGS. 13A and 13B illustrate differences in the post-stage processing to be performed for each conventional recording medium.
Figure 13A:
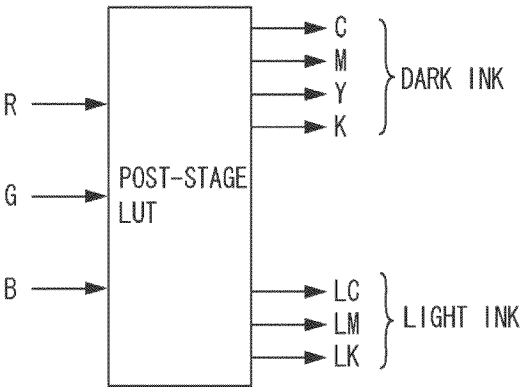
Figure 14B:
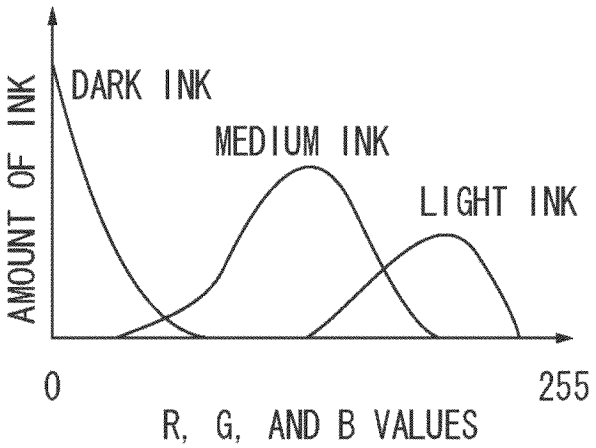
FIGS. 14A and 14B illustrate differences in the amount of ink usable for each conventional recording medium.
Figure 14A:
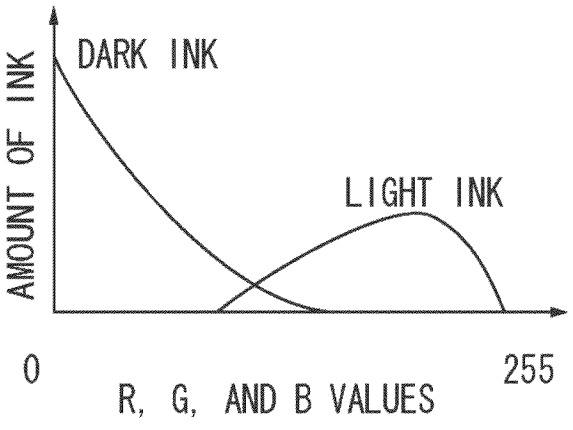

FIGS. 13A and 13B illustrate example processing for converting R, G, and B data into values of inks to be used referring to the plain paper LUT and the coated paper LUT illustrated in FIG. 12. FIGS. 14A and 14B are graphs illustrating differences between the plain paper LUT and the coated paper LUT that are used in the processing illustrated in FIG. 12. In FIGS. 14A and 14B, the ordinate axis represents the amount of an ink corresponding to a value of each color having been subjected to the post-stage processing, and the abscissa axis indicates R, G, and B values ranging from 0 to 255 with respect to a predetermined hue that can be reproduced by the above-described printer. In FIGS. 14A and 14B, there are illustrated the amounts of inks of K, MK, and LK used for printing a gray line.

FIG. 14A illustrates an example for the plain paper LUT, according to which the light ink is mainly used in a region corresponding to a highlight portion and the dark ink is mainly used in a region corresponding to other portions (e.g., a halftone portion and a shadow portion). The example illustrated in FIG. 14A can be effectively used to reduce the amount of an ink to be consumed for recording on plain paper because the dark ink is positively used for the halftone and shadow portions where the graininess is inconspicuous.

On the other hand, FIG. 14B illustrates an example of the coated paper LUT, according to which the light ink is mainly used in a region corresponding to a highlight portion, the medium ink is mainly used in a region corresponding to a halftone portion, and the dark ink is manly used in a region corresponding to a shadow portion. The example illustrated in FIG. 14B can be effectively used to reduce the graininess in the highlight portion and improve the gradation characteristics not only in the highlight portion but also in the shadow portion.

Using the above-described two types of post-stage LUTs that are differentiated in the combination of color material densities of the inks that can be used for the plain paper and the coated paper is useful to reduce the amount of an ink to be consumed for the plain paper and also to maintain adequate graininess and gradation characteristics for the coated paper.

However, performing the above-described ink selection differentiated for the plain paper and the coated paper may reduce the glossiness of a recorded image because the dark ink is used for glossy paper, as described above. Hence, an example method for using inks in performing recording on glossy papers (that are classified into a first recording medium) and mat papers (that are classified into a second recording medium) according to the present invention is described below. According to experimental demonstrations or tests conducted by inventors of the present invention, in a case where an image having a predetermined density is formed on a recording medium, the smoothness of a printed surface can be improved by forming the image with the light ink rather than forming the image with the dark ink.

Figure 1A:
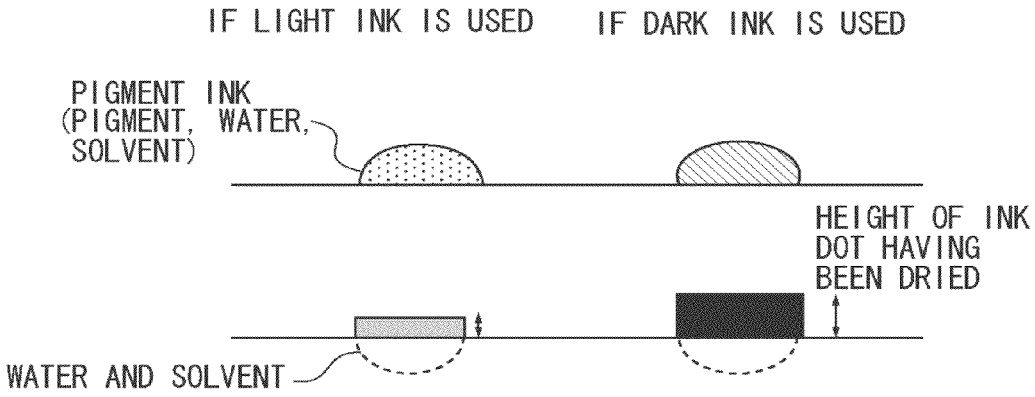
FIGS. 1A and 1B are schematic views illustrating example impact of pigment inks according to a first exemplary embodiment.
Figure 1B:
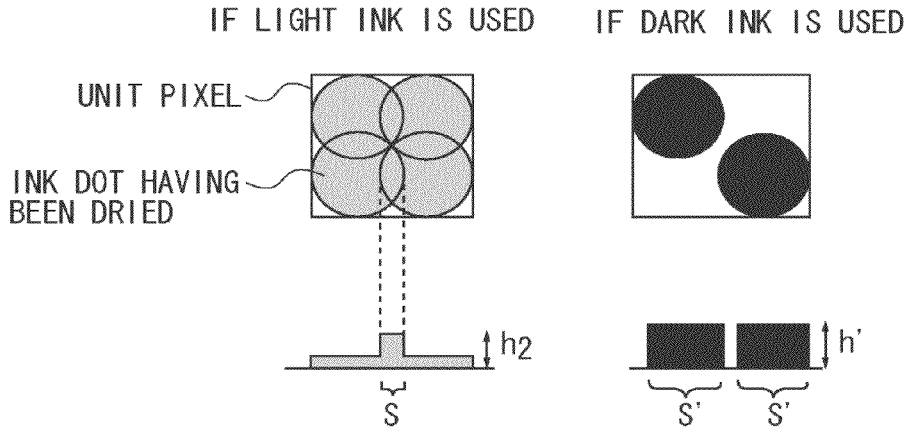

FIG. 1B illustrates a dot layout on a paper surface and a cross-sectional view of an image having a predetermined density, which can be formed with four dots when the light ink is used or two dots when the dark ink is used. As understood from FIG. 1B, an area S (dot height $h_2$) where dots are overlapped locally and a printed surface is greatly undulated when the light ink is used is lower in height than an area S' (dot height h') where a printed surface is greatly undulated when the dark ink is used. More specifically, the usage of the light ink is effective not only in that the height of a single ink dot can be lowered but also in that the overlap between impacted dots can be reduced even when an image of a predetermined density is formed. Thus, the usage of the light ink is effective to improve the smoothness of a printed surface.

Figures 15A, 15B:
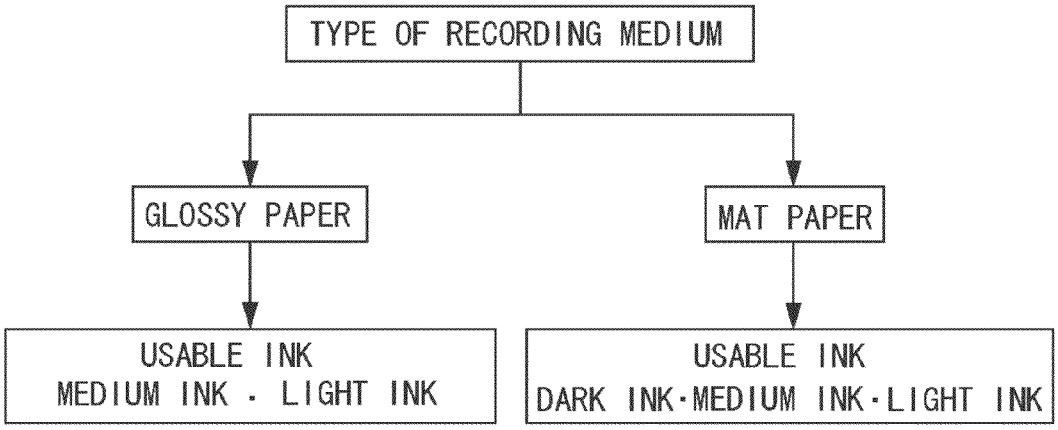
FIGS. 15A and 15B illustrate a relationship between each recording medium and usable inks according to the first exemplary embodiment.

Considering the foregoing, the apparatus according to the present exemplary embodiment selects an ink set to be used for each recording mode based on information relating to the type of the recording medium of the application J0001 illustrated in FIG. 15A. More specifically, the apparatus according to the present exemplary embodiment uses an ink set including the light ink and the medium ink in a glossy paper mode (i.e., a first mode for prioritizing the glossiness) without using the dark ink. Further, the apparatus according to the present exemplary embodiment uses an ink set including the light ink, the medium ink, and the dark ink in a mat paper mode (i.e., a second mode for prioritizing the color developing properties).

FIG. 15B illustrates an example classification for various recording media that can be set by the application J0001, according to which "A" indicates a recording medium to be recorded in the glossy paper mode and "B" indicates a recording medium to be recorded in the mat paper mode. In the present exemplary embodiment, as described above, a recording medium having a degree of glossiness equal to or greater than 2% (e.g., glossy paper, semi-glossy paper, film, OHP, and photographic printing paper) is classified into the recording medium A and a recording medium having a degree of glossiness less than 2% is classified into the recording medium B.

In general, particles that constitute an ink receptive layer of the glossy paper have a small particle diameter. Therefore, the glossy paper is excellent in glossiness but slow in ink absorbency. On the other hand, particles that constitute an ink receptive layer of the mat paper have a large particle diameter. Therefore, the mat paper is insufficient in glossiness but fast in ink absorbency. Examples of the glossy paper and the mat paper are discussed in Japanese Patent Application Laid-Open No. 9-99628 and Japanese Patent Application Laid-Open No. 2007-90864.

Figure 16B:
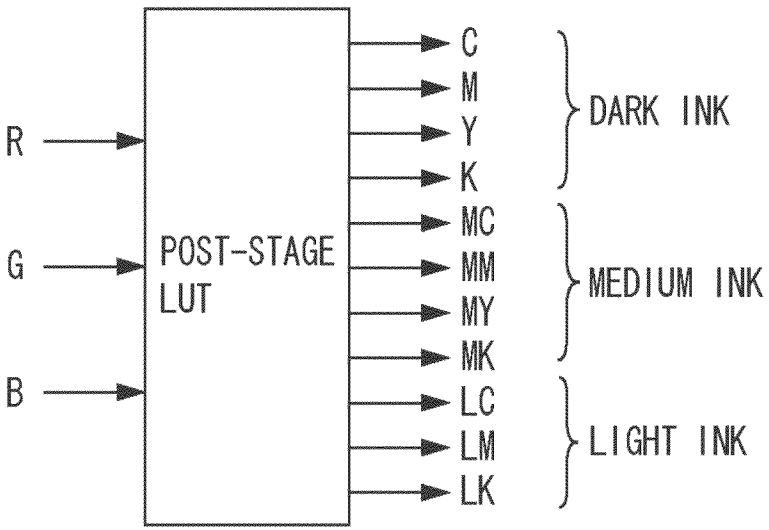
FIGS. 16A and 16B illustrate example post-stage processing to be performed for each recording medium according to the first exemplary embodiment.
Figure 16A:
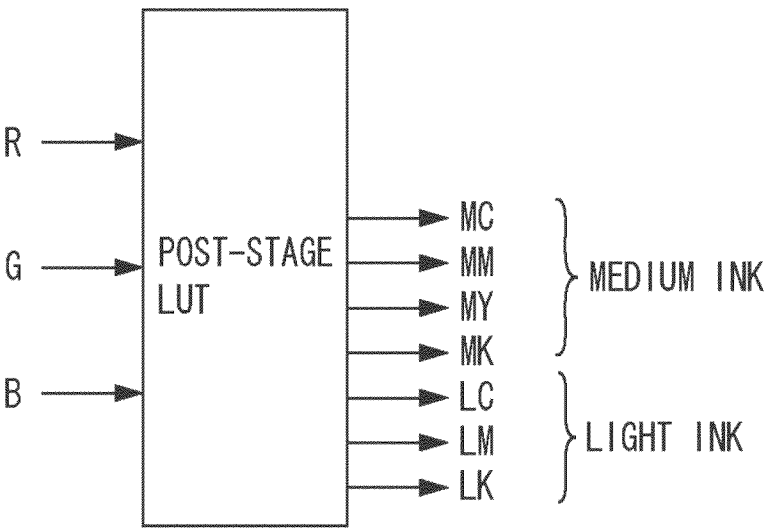
Figure 17A:
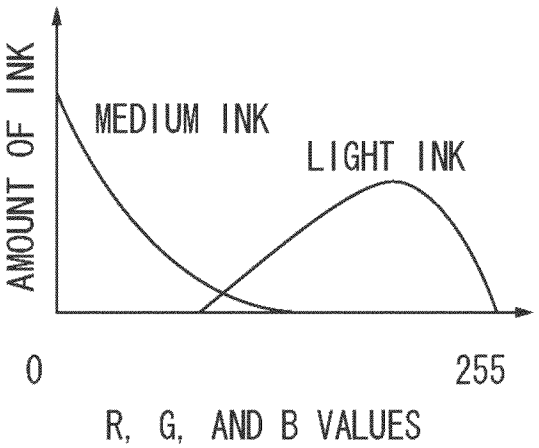
FIGS. 17A and 17B illustrate the amount of ink usable for each recording medium according to the first exemplary embodiment.
Figure 17B:
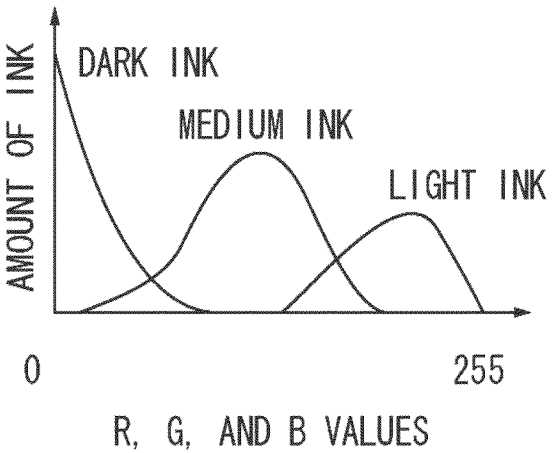

FIGS. 16A and 16B illustrate example processing for converting R, G, and B data into values of inks to be used referring to the glossy paper LUT and the mat paper LUT illustrated in FIG. 15A. FIG. 17A is a graph corresponding to the post-stage LUT dedicated to glossy papers. FIG. 17B is a graph corresponding to the post-stage LUT dedicated to mat papers. In FIGS. 17A and 17B, there are illustrated the amount of inks of K, MK, and LK similar to those illustrated in FIGS. 14A and 14B. The abscissa axis indicates R, G, and B values ranging from 0 to 255 that can be reproduced by the above-described printer, and the ordinate axis represents the amount of an ink corresponding to a value of each color having been subjected to the post-stage processing.

According to the example illustrated in FIG. 17A, the light ink is mainly used in a region corresponding to a highlight portion and a halftone portion and the medium ink is mainly used in a region corresponding to the halftone and a shadow portion. The medium ink included in the ink set according to the present exemplary embodiment can assure sufficient color reproduction properties for the glossy paper. Therefore, it is unnecessary to positively use the dark ink.

According to the example illustrated in FIG. 17B, the light ink is mainly used in a region corresponding to a highlight portion, the medium ink is mainly used in a region corresponding to a halftone portion, and the dark ink is mainly used in a region corresponding to a shadow portion. The example illustrated in FIG. 17B can be effectively used to improve the color developing properties of the mat papers by positively using the dark ink in the shadow portion.

As described above, in the present exemplary embodiment, the recording in the glossy paper mode is performed with the medium ink and the light ink (i.e., without using the dark ink). Further, the recording in the mat paper mode is performed with all of the dark ink, the medium ink, and the light ink. Further, the apparatus according to the present exemplary embodiment can selectively use one of two types of post-stage LUTs according to a recording medium to satisfy both high glossiness of a recorded image when the glossy paper is used and high color developing properties when the mat paper is used.

The ink set used in the above-described exemplary embodiment includes eleven colors C, MC, LC, M, MM, LM, Y, MY, K, MK, and LK. However, the present exemplary embodiment is not limited to the above-described ink set. The present invention intends to provide an inkjet recording apparatus that can perform recording without using the dark ink for glossy papers to maintain glossiness of a recorded image and can use the dark ink for mat papers to improve color developing properties.

Accordingly, to attain the goal of the inkjet recording apparatus according to the present invention, it is useful to use an ink set including any combination of colors and color material densities that can be reproduced on glossy papers and mat papers. For example, to reduce the total number of ink tank types, it is useful to use an ink set including cyan, magenta, and yellow pigment materials (not including black pigment material). Further, for example, it is useful to add different types of color inks, such as red and green special inks and transparent inks.

Figure 18:
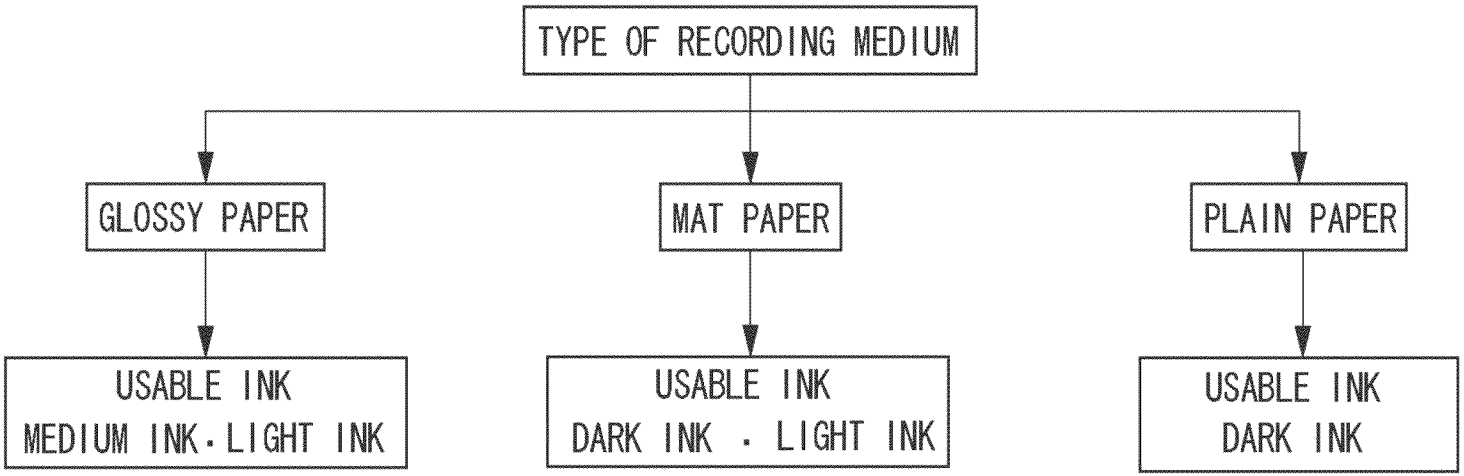
FIG. 18 illustrates a relationship between each recording medium and usable inks according to the first exemplary embodiment.

Further, as illustrated in FIG. 18, the apparatus according to the present exemplary embodiment can operate in a third mode for performing printing on plain papers (that are classified into a third recording medium) that is different from the coated paper in material. More specifically, the apparatus according to the present exemplary embodiment can use the light ink and the medium ink for glossy papers. The apparatus according to the present exemplary embodiment can use the light ink and the dark ink for mat papers, and can use only the dark ink for plain papers to improve the color developing properties of the ink.

Further, the apparatus according to the present exemplary embodiment uses both the medium ink and the light ink in the glossy paper mode for performing recording on glossy papers. However, the apparatus according to the present exemplary embodiment can use only one of the medium ink and the light ink in the glossy paper mode. Further, the apparatus according to the present exemplary embodiment performs recording using all of the dark ink, the medium ink, and the light ink in the mat paper mode for performing recording on mat papers. However, the apparatus according to the present exemplary embodiment can eliminate any color ink other than the dark ink that is used to improve the color developing properties.

Further, the apparatus according to the present exemplary embodiment employs the degree of glossiness as an index to be used to classify glossy papers and mat papers. However, the apparatus according to the present exemplary embodiment can employ the above-described image clarity instead of using the degree of glossiness or can employ both the degree of glossiness and the image clarity.

Further, the apparatus according to the present exemplary embodiment determines a type of a recording medium that is currently fed, based on information input by a user via a display screen of the host apparatus 110. The apparatus then determines an appropriate LUT for the post-stage processing to be performed. In this case, the user can press a recording medium selection switch, which is provided on an apparatus body, to input information indicating the type of the recording medium. Moreover, the controller 100 of the recording apparatus can perform the above-described sequential processing, which can be executed with the printer driver 111 of the host apparatus 110 illustrated in FIG. 8.

Next, a second exemplary embodiment of the present invention is described below. The second exemplary embodiment is similar to the first exemplary embodiment except for the following features. In the first exemplary embodiment, the apparatus uses an ink set including the medium ink and the light ink (not including dark ink) to prioritize the high glossiness of a printed image to be formed on a glossy paper. However, even in a case where the recording is performed on a glossy paper, high glossiness of an image formed on the glossy paper may not be required and rather the color developing properties may be prioritized. Hence, the apparatus according to the present exemplary embodiment is configured to enable users to arbitrarily set a recording mode via the display screen of the host 110 to surely realize glossiness and color developing properties according to user's preference, when recording is performed on glossy papers.

Figure 19:
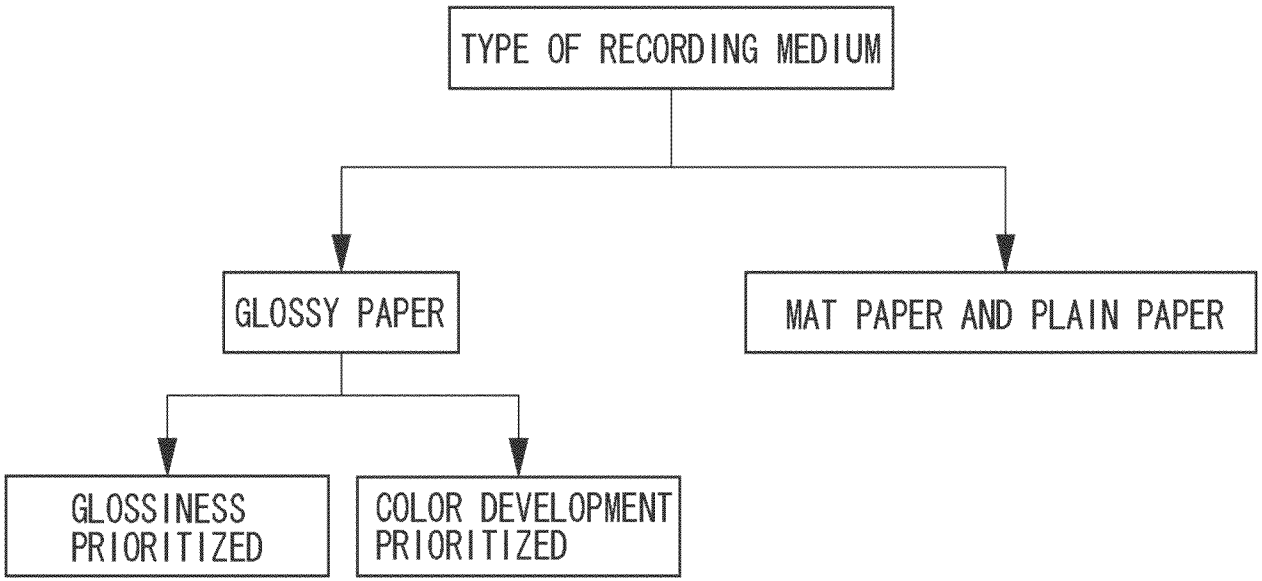
FIG. 19 illustrates a relationship between a recording medium and usable inks according to a second exemplary embodiment.
Figure 20:
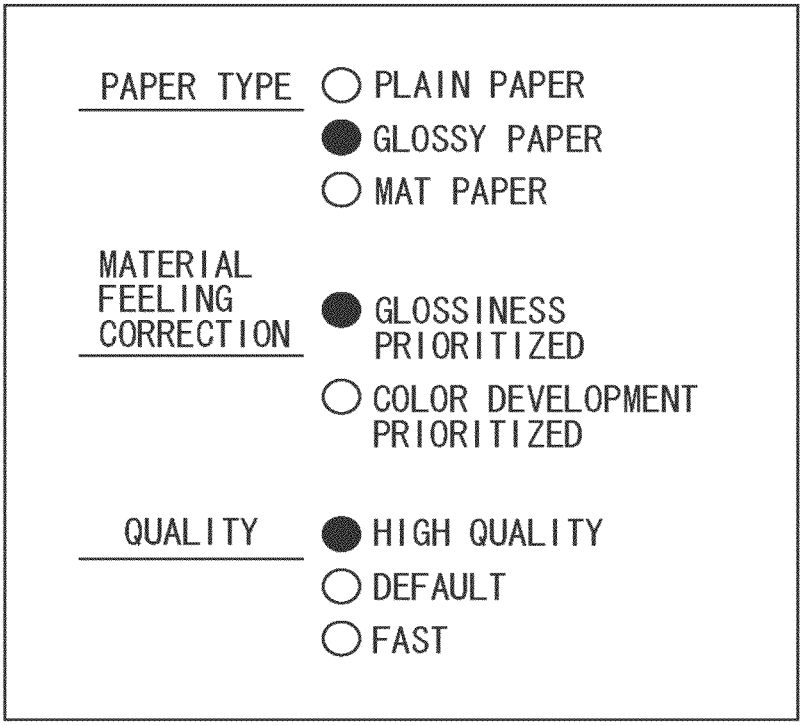
FIG. 20 illustrates an example display to be performed by a host apparatus, which enables users to perform manual setting of a recording mode.

In the present exemplary embodiment, a user interface (UI) illustrated in FIG. 20 can be used to enable users to manually set a recording mode. FIG. 19 illustrates an example relationship between a sheet type and a recording mode that can be realized in the present exemplary embodiment, for the recording modes that can be set on the display screen of the host 110. As understood from FIG. 19, if the selected "sheet type" is the glossy paper, the apparatus can operate in the above-described first mode, i.e., "glossiness prioritized mode" or in a fourth mode, i.e., "color development prioritized mode."

FIG. 21 illustrates an example table that describes ink sets applicable to the "glossiness prioritized mode" and the "color development prioritized mode" dedicated to glossy papers as well as ink sets applicable to mat papers. If the "glossiness prioritized mode" dedicated to glossy papers is selected, the apparatus according to the present exemplary embodiment performs recording using only the medium ink and the light ink (without using the dark ink), thereby maintaining the glossiness of an appropriate level for a printed image.

On the other hand, if the "color development prioritized mode" dedicated to glossy papers or the mat paper is designated, the apparatus according to the present exemplary embodiment performs recording using the dark ink, the medium ink, and the light ink to realize higher color developing properties. Further, the table illustrated in FIG. 21 enables users to select the plain paper. If the plain paper is selected, the apparatus according to the present exemplary embodiment performs recording using the dark ink and the light ink.

As described above, the apparatus according to the present exemplary embodiment can perform color development prioritized recording on a glossy paper when a user designates the color development prioritized mode for recording on the glossy paper with the dark ink.

Next, a third exemplary embodiment of the present invention is described below. The above-described exemplary embodiment uses various combinations of ink sets for a plurality of modes. Further, it is useful to register predetermined operations beforehand as recording operations to be performed in respective modes. The table illustrated in FIG. 21 includes examples of the recording operation in addition to the combinations of ink sets.

The apparatus according to the present exemplary embodiment allows a user to select any one of three print modes with respect to each of glossy paper, mat paper, and plain paper. The three print modes include "fine" mode in which image quality is prioritized, "fast" mode in which speedy is prioritized, and "normal" mode. An ink set to be used and the number of recording passes are determined according to the selected recording medium and print mode. As in the second exemplary embodiment, since the "glossiness prioritized mode" or the "color development prioritized mode" can be selected for the glossy paper, any one of the print modes can be selected with respect to each of the "glossiness prioritized mode" or the "color development prioritized mode".

In the example illustrated in FIG. 21, If the "glossiness prioritized mode" dedicated to glossy papers is selected, the apparatus according to the present exemplary embodiment performs recording using only the medium ink or using the medium ink and the light ink without using the dark ink with respect to every one of the print modes. If the "color development prioritized mode" dedicated to glossy papers or the mat paper is designated, the apparatus according to the present exemplary embodiment performs recording using inks involving the dark ink with respect to every one of the print modes. If the plain paper is designated, the apparatus according to the present exemplary embodiment disables selection of the "fine" mode and performs recording using inks involving the dark ink with respect to the "normal" mode and the "fast" mode.

In all of the modes, the number of passes for recording is set greater in a mode in which image quality is more prioritized. When the glossy paper is selected, the number of passes for the "glossiness prioritized mode" is smaller than that for the "color development prioritized mode." This is because it is useful to reduce the overlap between ink dots to maintain the glossiness of an appropriate level.

As described above, the apparatus according to the present exemplary embodiment can set both an ink set to be used for recording and the number of recording passes according to setting of a type of recording medium and a print mode. Thus, the apparatus according to the present exemplary embodiment can provide a recorded image that can satisfy a user's request.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-109391 filed Apr. 28, 2009, which is hereby incorporated by reference herein in its entirety.

What is claimed is:

1. An apparatus configured to print an image using a first ink, a second ink having a pigment density that is lower than that of the first ink and being similar to the first ink in color, and a third ink having a pigment density that is lower than that of the second ink and being similar to the first ink and the second ink in color, wherein the apparatus is capable of performing a first mode for printing the image on a first print medium using at least one of the second ink and the third ink, and a second mode for printing the image on a second print medium, which has a lower glossiness than the first print medium, using at least the first ink.

2. The apparatus according to claim 1, wherein the first recording medium is glossy paper and the second recording medium is mat paper.

3. The apparatus according to claim 1, wherein the second mode is a mode for printing the image using the first ink, the second ink, and the third ink.

4. The apparatus according to claim 1, wherein the first mode is a mode for printing the image using both the second ink and the third ink.

5. The apparatus according to claim 1, wherein the apparatus is capable of operating in a third mode for printing the image on a third recording medium, which is different in material from the first recording medium and the second recording medium, using the first ink.

6. The apparatus according to claim 1, wherein the apparatus is capable of operating in a fourth mode for printing the image on the first recording medium using at least the first ink.

7. The apparatus according to claim 1, wherein the first ink includes black pigment.

8. The apparatus according to claim 1, wherein the first ink includes cyan pigment.

9. The apparatus according to claim 1, wherein the first ink includes magenta pigment.

10. A system comprising a recording apparatus configured to perform recording with at least three types of inks that are similar in color and different in pigment density, and a supply apparatus configured to supply image data to the recording apparatus, wherein the system is configured to select one mode to be executed from a plurality of modes based on at least a signal indicating a type of recording medium, the plurality of modes including:

a first mode for printing the image on a first recording medium using at least one of a second ink having a pigment density that is lower than that of a first ink and a third ink having a pigment density that is lower than that of the second ink; and a second mode for printing the image on a second recording medium, which has a lower glossiness than the first recording medium, using at least the first ink.

11. The system according to claim 10, wherein the first recording medium is glossy paper and the second recording medium is mat paper.

12. The system according to claim 10, wherein the second mode is a mode for printing the image using the first ink, the second ink, and the third ink.

13. The system according to claim 10, wherein the first mode is a mode for printing the image using both the second ink and the third ink.

14. The system according to claim 10, wherein the recording apparatus is capable of operating in a third mode for printing the image on a third recording medium, which is different in material from the first recording medium and the second recording medium, using the first ink.

15. The system according to claim 10, wherein the recording apparatus is capable of operating in a fourth mode for printing the image on the first recording medium using at least the first ink.

* * * * *